United States Patent [19]

McKenney

[11] Patent Number: 4,543,905

[45] Date of Patent: Oct. 1, 1985

[54] PORTABLE TRAFFIC SIGNALLING APPARATUS AND METHODS THEREFOR

[75] Inventor: John D. McKenney, South Laguna, Calif.

[73] Assignee: Lear Siegler, Inc., Santa Monica, Calif.

[21] Appl. No.: 548,205

[22] Filed: Nov. 2, 1983

[51] Int. Cl.[4] ..... E01F 9/10

[52] U.S. Cl. ..... 116/63 P; 362/61; 116/202; 40/610; 40/612

[58] Field of Search ..... 116/202, 63 P, 63 R; 40/610, 612; 362/61, 205; 248/647, 124

[56] References Cited

U.S. PATENT DOCUMENTS 1,843,956 2/1932 Otte ..... 116/63 P 3,586,270 6/1971 Loffler et al. ..... 362/61

OTHER PUBLICATIONS

Handling Equipment, Ltd., Literature on "Temp-Lite'-'—Intersection Model—no date.

Handling Equipment, Ltd., Literature on "Temp-Lite'-'—Highway Model—no date.

*Primary Examiner*—Charles Frankfort

*Assistant Examiner*—Thomas B. Will

*Attorney, Agent, or Firm*—Edward J. DaRin

[57] ABSTRACT

A portable traffic signalling apparatus of the wheeled trailer type for temporary signalling at a traffic location for controlling the flow of traffic thereat. The apparatus includes a telescoping mast and a telescoping boom carried by the trailer for positioning at the traffic location. The telescoping action is performed without any large bending loads to permit the extended boom carrying a traffic signal to be moved over a traffic lane under traffic conditions after the traffic apparatus is erected alongside of the traffic location. The extended mast may also carry a traffic signal to be viewed by motorists along with the boom suspended traffic signal. The mast and boom can be telescopically collapsed to assume a storage position on the wheeled trailer after the need for traffic control has been eliminated to allow the trailer to be hauled to another location.

22 Claims, 20 Drawing Figures

FIG. 5.
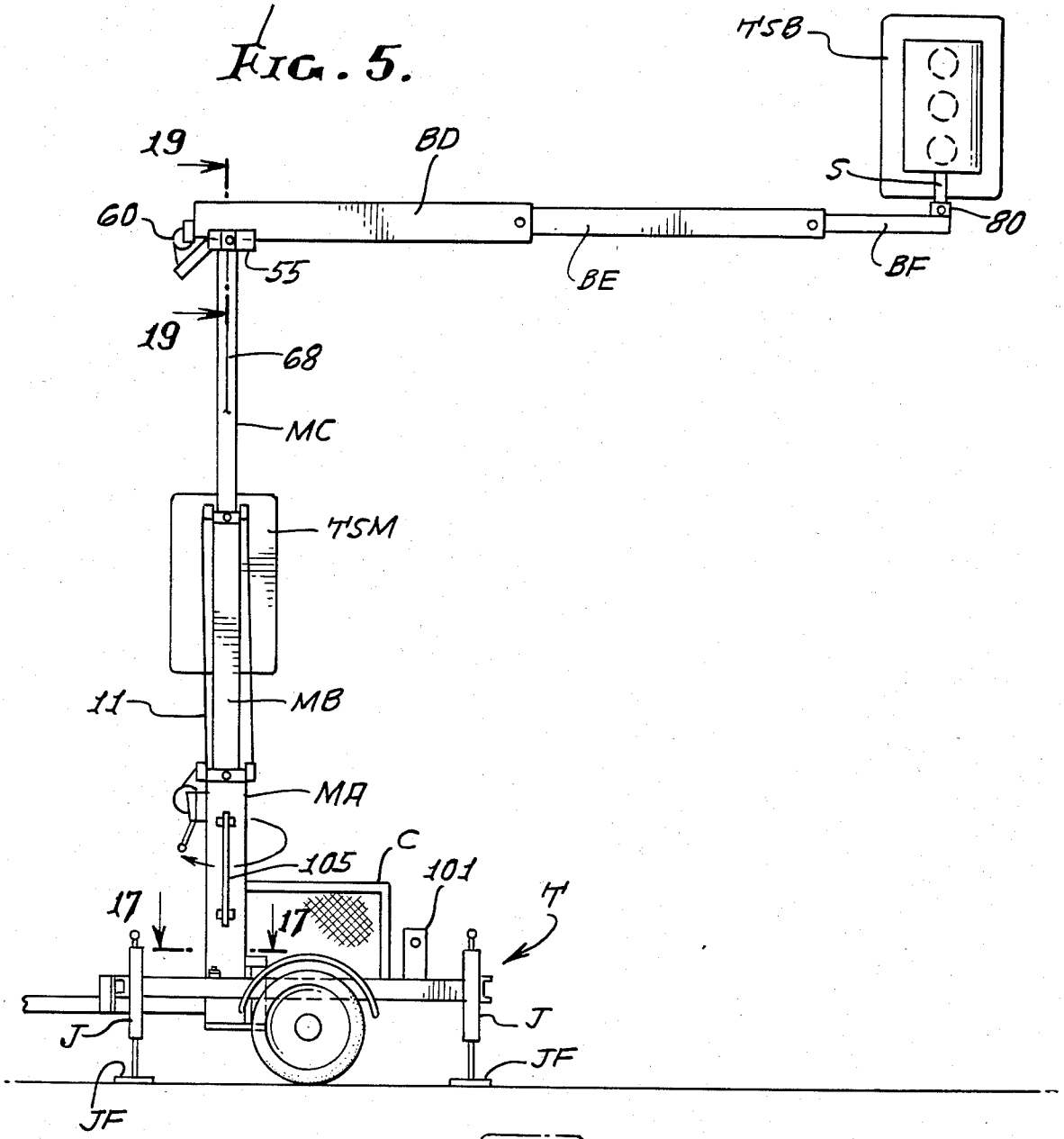
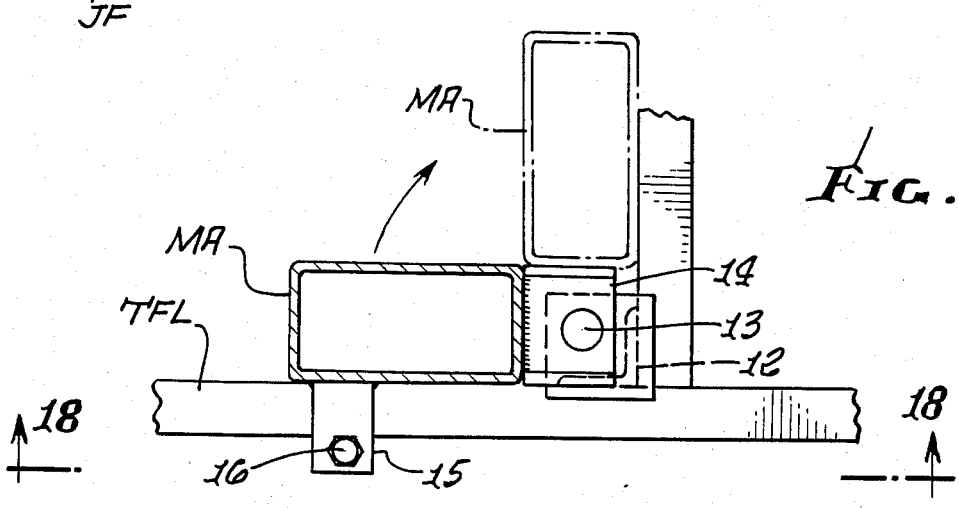
FIG. 17.

FIG. 6.
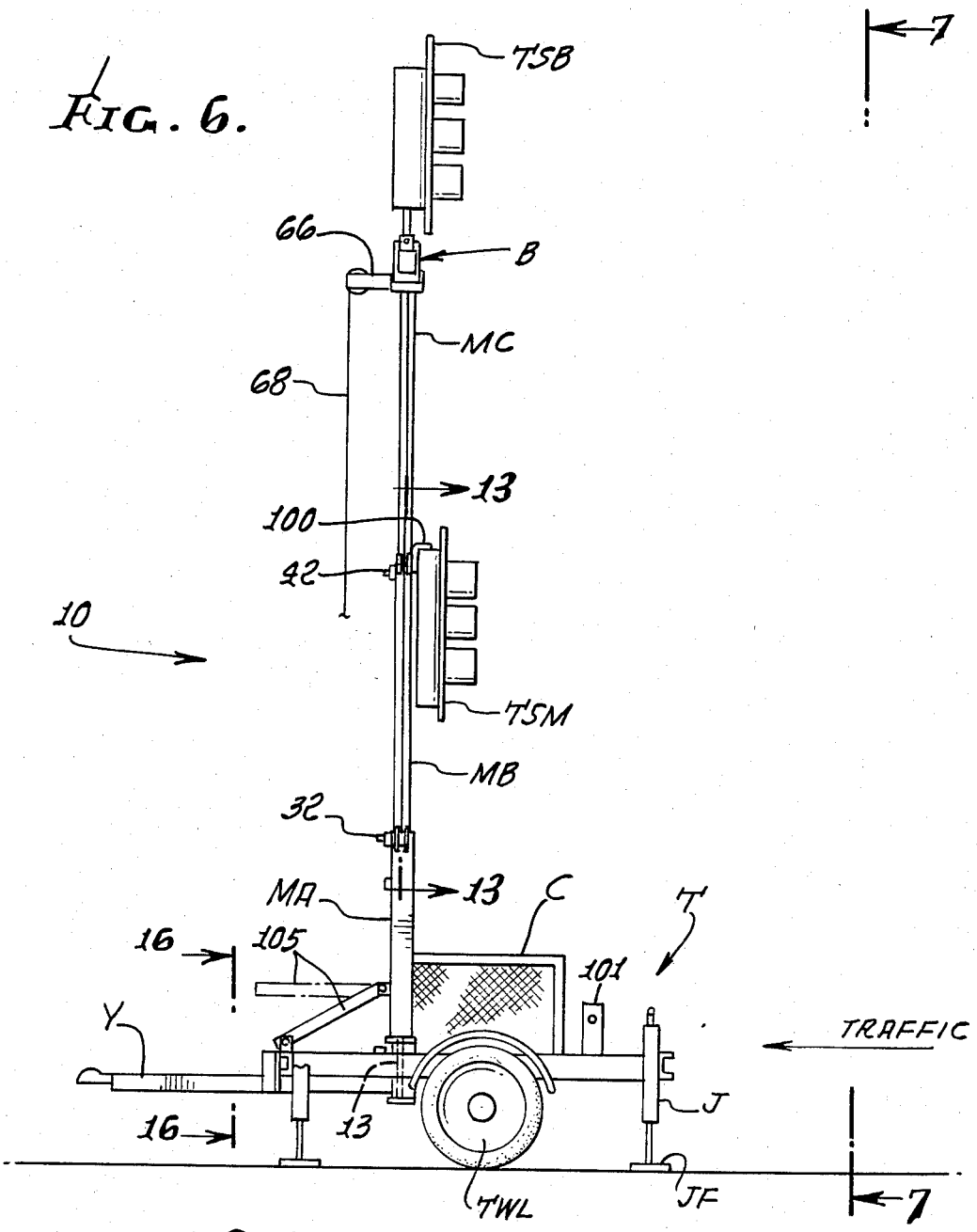
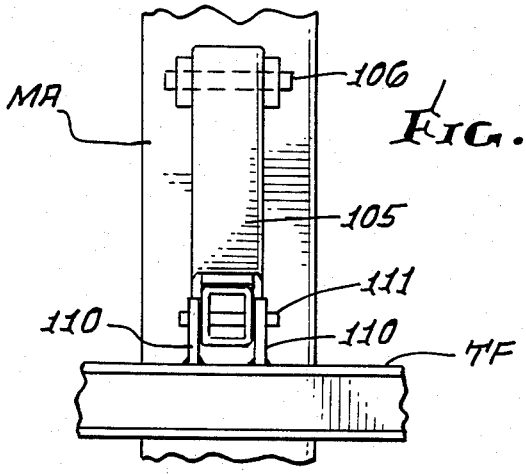
FIG. 16.

9
62
62a
61
60
60a
11
BD
65
55
66
54
53
67
MC
10
86
95
94
51
42
46
63
MB
50
85
93
92
36
32
68
MA
TO WINCH 90
10
11
11
9

PORTABLE TRAFFIC SIGNALLING APPARATUS AND METHODS THEREFOR

FIELD OF THE INVENTION

The present invention relates to method and apparatus for portable, temporary, traffic signalling apparatus and more particularly to improved, transportable, traffic signalling apparatus of the wheeled trailer type having electrically controlled traffic signals that are extendable on the trailer between a traffic display position over a lane of traffic and a collapsed storage position for transit to a new location.

BACKGROUND OF INVENTION

Traffic signals are generally permanently mounted at traffic intersections to control the flow of traffic at an intersection or the like. These traffic signals are electrically controlled to sequentially illuminate either a red light, a green light, or an amber light, to signal and control the flow of traffic through intersections. These traffic signals are generally mounted on a vertical mast on the corners of an intersection in a permanent manner. In addition, a boom may be utilized along with the corner mounted masts to display a traffic signal over the traffic lanes to increase the visibility of the traffic signal to motorists approaching the intersection or point of traffic control. If these permanent traffic signals are damaged, the power is lost, or in any manner are rendered inoperative, some means is required to function for traffic control before the traffic signals are again rendered operative. To the same end, construction on a road or highway may require some form of temporary traffic control. These temporary measures may include individuals standing in the traffic lanes to control the flow of traffic, either in the form of a policeman or construction worker. Presently known temporary traffic control signals generally comprise a conventional signal mounted on a portable mast arm of a unitary structure that can be positioned adjacent the damaged signal for traffic control. Other known portable devices are similarly mounted and include a traffic control device having four sets of traffic signals that are mountable in the center of an intersection to control the flow of traffic in all directions. This temporary traffic control device mounts the traffic signals on a mast that is controlled by an electric winch for moving the electrical signals along the mast to display the signals at an elevated position and a lowered position for transit purposes. Another type of transportable traffic control apparatus is mounted on a wheeled trailer carrying a mast for supporting traffic signals on individually movable booms. The booms are controlled by a winch system to move the booms from a low transit position to an elevated traffic signalling position. The booms are designed to have individually adjustable spans relative to the mast. This type of transportable traffic control apparatus is designed to be positioned alongside of a traffic lane. No temporary traffic signal is presently known that includes a boom carrying a traffic signal for displaying a traffic signal over a traffic lane for traffic control.

SUMMARY OF INVENTION

The present invention provides an improved, portable trailer mounted traffic signal apparatus including a telescoping mast and telescoping boom for suspending a traffic signal over a traffic lane to render it clearly visible. An important advantage of the improved apparatus is that the telescoping mast and boom are constructed and defined to be extended or collapsed in unison without any large bending loads on the apparatus and friction is minimized. The improved apparatus can be transported adjacent a street or highway requiring traffic control and can be completely erected out of the path of the motor vehicle traffic and then swung over a traffic lane under traffic conditions, without danger or damage to passing motorists, trucks, pedestrians, or the apparatus operating personnel. The apparatus of the present invention is easy to set up in a matter of five minutes, return to a storage/transit condition in approximately the same amount of time, and adapted to be readily hauled to the next location requiring traffic control. The apparatus can be used alone or with other portable traffic control signals by construction companies, or governmental entities to decrease the number of people required for traffic control purposes. The improved apparatus can display a traffic signal on the telescoping mast on the side of the traffic lane, along with the traffic signal mounted on the boom overlying the traffic lane.

From a broad structural standpoint, the present invention comprehends portable traffic apparatus having a supporting structure carrying a telescopic mast means adapted to be controlled between telescopically extended and collapsed positions. A telescopic boom means is pivotally secured to the mast means and is adapted to be controlled between telescopically extended and collapsed positions. The supporting structure is provided with means for releasably securing the free end of the boom means to the supporting structure. Control means is coupled to the mast means and the boom means to selectively, telescopically extend and collapse the mast and the boom in unison under no load conditions when the boom means is secured at the boom securing means.

From a specific structural standpoint, the portable traffic signal of the present invention includes a supporting structure of the wheeled trailer type. Telescopic mast means, having a plurality of telescopic sections slidable inside another section to be controllably moved between telescopically extended and collapsed positions, is mounted to the supporting structure. Means are provided for releasably securing the individual telescopic mast sections in either the extended or collapsed positions. Telescopic boom means, having a plurality of telescopic sections slidable inside another section to be controllably moved between extended and collapsed positions, is pivotally mounted adjacent one end to the free end of the mast means to permit the telescopic boom sections to be extendable and collapsible in unison with the movements of the telescopic sections for the mast means. The free end of the boom means is adapted to mount a traffic signal thereon and to be releasably secured to the supporting structure when the traffic signal is not mounted thereon. The supporting structure includes means for releasably securing the free end of the boom means thereto. Control means is coupled to the mast and the boom to selectively move the plurality of telescopic sections between extended and collapsed positions in unison when the boom means is secured to the boom securing means. The control means is further characterized as being selectively controllable to pivotally swing the extended boom means carrying traffic signalling means about the mast means to position the boom between a traffic signalling position and the boom securing means when the boom has been released from the securing means. Means is carried by the boom means for releasably securing the boom in a traffic signalling position. When the traffic signalling apparatus is positioned adjacent the roadside, it may be erected along the roadside. The apparatus includes means for rotating the mast and thereby the boom over a traffic lane without interfering with the vehicular traffic.

BRIEF DESCRIPTION OF THE DRAWINGS

These and other features of the present invention may be fully appreciated when considered in the light of the following specification and drawings, in which:

FIG. 5 is a side elevational view of the apparatus of FIG. 4 with the boom fully erected but arranged parallel to a traffic lane in a non-signalling position;

FIG. 6 is a side elevational view similar to FIG. 5 but illustrating the mast after it has been rotated ninety degrees to suspend the boom and traffic signal over the traffic lane;

FIG. 16 is a partial view, taken along the line 16—16 of FIG. 6, illustrating the securing means for the rotary handle;

FIG. 17 is a view, taken along the line 17—17 of FIG. 5, of the mast and illustrating the rotated position of the mast in dotted outline;

DETAILED DESCRIPTION OF THE INVENTION

Figure 1:
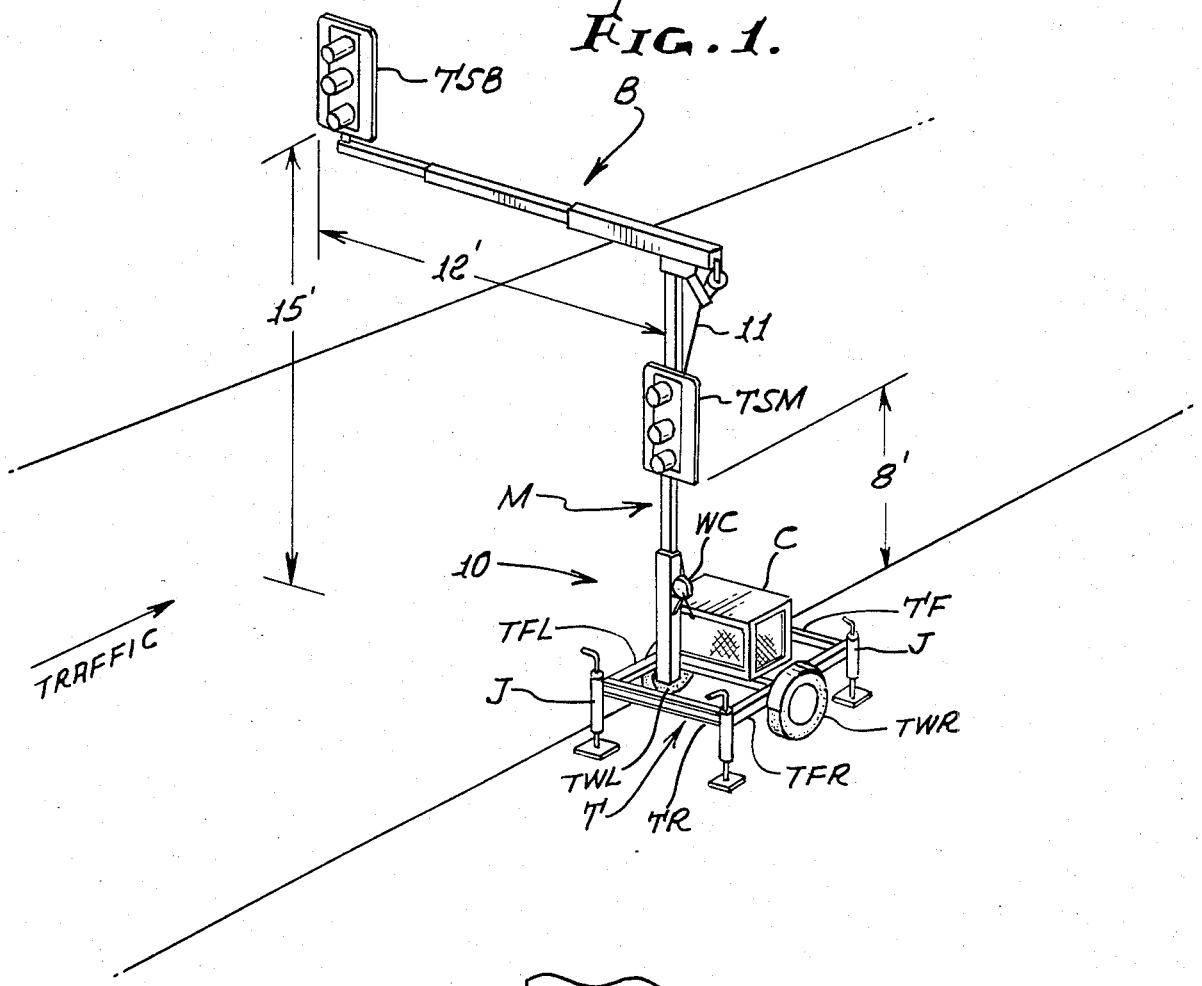
FIG. 1 is a diagrammatic representation of a traffic lane illustrating the trailer mounted, traffic signalling apparatus, embodying the present invention, positioned and erected on the side of the traffic lane with a traffic signal extending over the traffic lane for traffic signalling purposes.

Now referring to the drawings, the portable traffic signalling apparatus 10 of the present invention will be described in detail. The trailer mounted traffic signalling apparatus 10 is illustrated in FIG. 1 as it may be positioned alongside a traffic lane for motor vehicles for traffic signalling purposes. The apparatus 10 includes a conventional traffic signal mounted thereon adjacent the traffic lane, with another traffic signal suspended over the traffic lane. In a typical application of the apparatus 10, the traffic signal TSM is mounted alongside the traffic lane at a minimum of eight feet from the ground with the traffic signal TSB suspended over the traffic lane at a minimum of fifteen feet above the ground and approximately twelve feet from the side light TSM. The traffic signals TSM and TSB are of conventional, commercially available construction that are electrically controlled to sequentially illuminate a red light, a green light and an amber light, in accordance with the usual traffic control pattern. The control of the illumination of the electrical signals is not part of the present invention and will not be described. The electrical power source and the electrical light controls are mounted and enclosed within a lockable wire mesh cage C carried by the trailer.

The apparatus 10 basically includes a supporting frame structure T illustrated as being of the wheeled trailer type. The supporting frame structure T carries telescopic mast means M adapted to be controlled between telescopically extended and collapsed positions. The apparatus 10 further includes telescopic boom means B pivotally secured to the mast means M and adapted to be controlled between telescopically extended and collapsed positions. The control means for the apparatus 10 comprises a winch cable system WC carried by the mast means M and coupled to the telescopic sections of the mast means M and the boom means B for uniformly and simultaneously controlling the positions of the mast M and the boom B. The alternate rotation of the winch cable system WC controls the payout and winding up of a cable 11 to correspondingly collapse or extend the telescopic sections of the mast M and the boom B. The control of the telescopic sections of the mast M and the boom B is accomplished while the free end of the boom is secured to the supporting structure T. The release of the boom B from the supporting structure allows the traffic signal TSB to be mounted adjacent the end thereof and, under the control of the winch cable system WC, to be pivotally swung about the mast M to suspend the extended boom B over a traffic lane.

Figure 2:
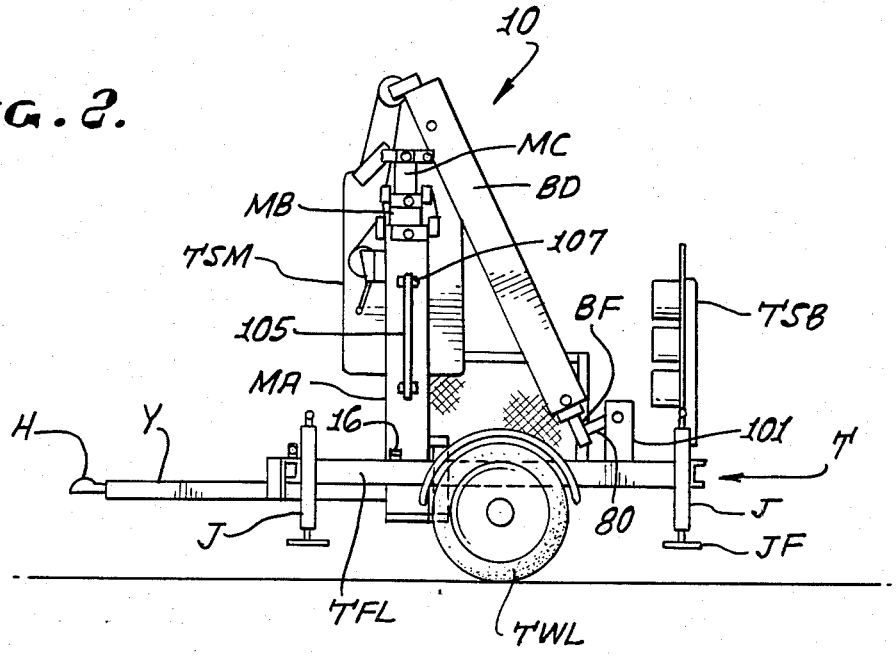
FIG. 2 is a side elevational view of the traffic signal apparatus of FIG. 1 arranged in the storage/transit position.
Figure 3:
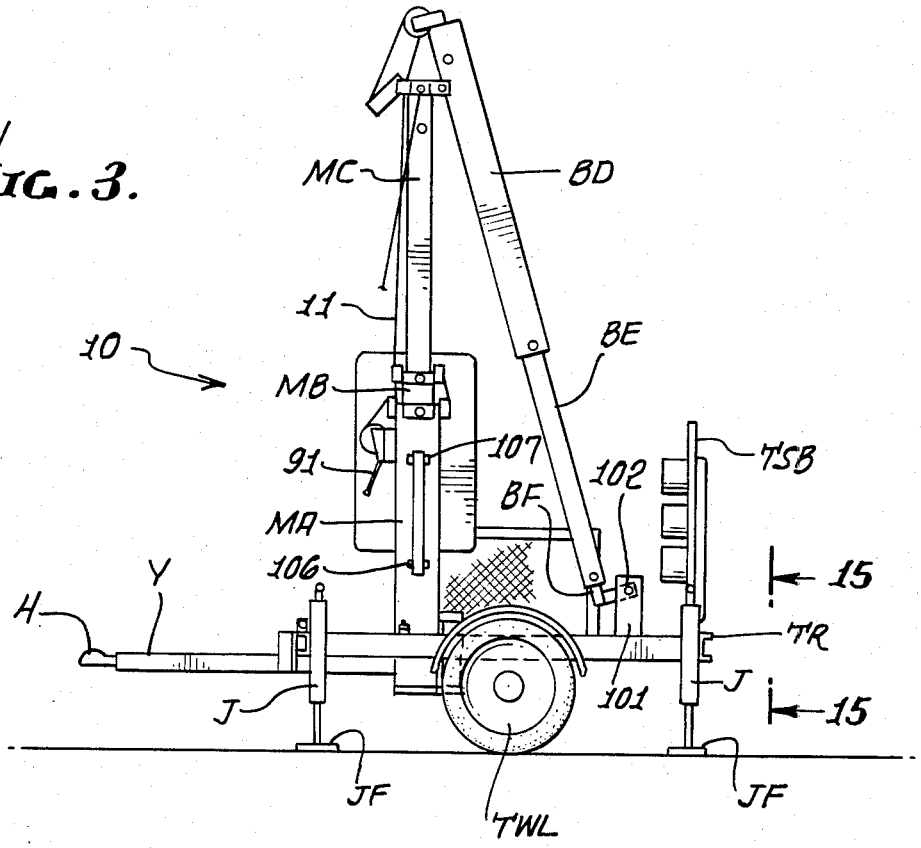
FIG. 3 is a side elevational view of the apparatus of FIG. 2 with the mast and boom partially extended and the boom secured to the trailer supporting structure.

The trailer frame structure T is symmetrically defined with a pair of longitudinally extending U-shaped structure members TFL and TFR arranged on opposite sides and are secured at their ends by a U-shaped cross member TF at the front of the structure T and U-shaped cross member TR at the rear end of the trailer. These structural members may be readily secured together by welding or any other suitable fastening means. The cage C for the power source and electrical controls for controlling the traffic signals TSM and TSB may be mounted on and secured to the longitudinally extending members TFL and TFR to be carried thereby, or in any other suitable manner. A pair of trailer wheel assembles are symmetrically arranged on opposite sides of, and intermediate the ends of the members TFL and TFR in a conventional fashion to permit the trailer frame T to be readily wheeled. The left hand assembly is identified in FIG. 1 as TWL, while the right hand wheel assembly is identified as TWR. A yoke Y comprising a square tubular member is carried by the trailer frame structure T by means of a bracket 8 (see FIG. 7) secured to the front cross member TF by suitable fasteners to extend forwardly thereof, as is illustrated in FIGS. 2 and 3, for example. The free end of the yoke member Y is secured to a trailer hitch H for hitching to a towing motor vehicle. For security purposes the yoke Y may be removed, as illustrated in FIG. 1, after the apparatus 10 has been erected adjacent the traffic lane for traffic control purposes. The supporting frame T is also provided with manually controlled stabilizing jacks J secured adjacent each corner of the frame for stabilizing the apparatus 10 during its use, including when it is subjected to high velocity winds, as will be described more fully hereinafter.

Figure 18:
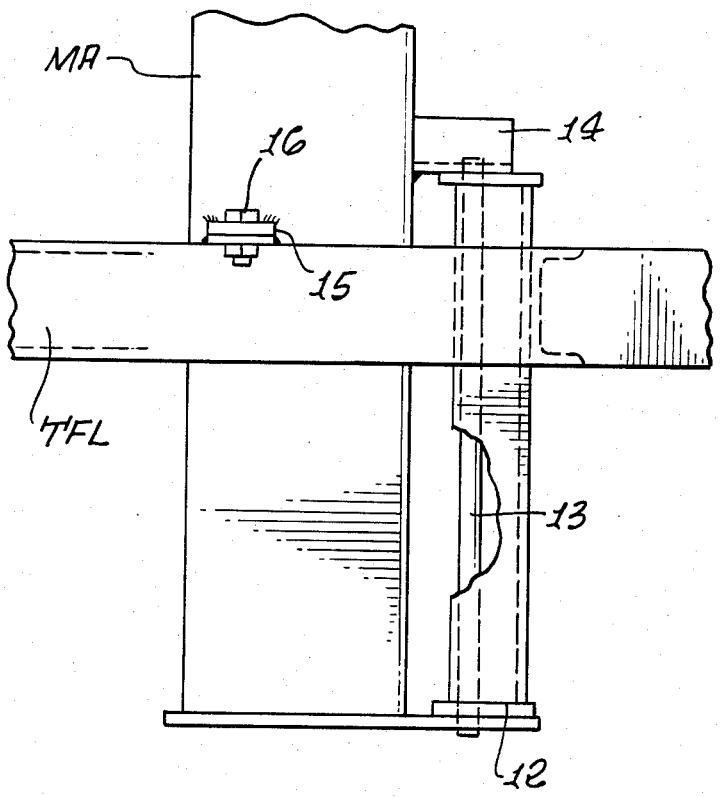
FIG. 18 is an elevational view, with portions broken away, taken along the line 18—18 of FIG. 17.

The mast M is rotatably secured to the frame T. For this purpose, the lower portion of the mast M, as illustrated in FIG. 18, is mounted to an L-shaped bracket 12 secured to the frame member TFL. The L-shaped bracket 12 extends below the frame member TFL and the lower end of the mast M is carried thereby. A pivot pin 13 is rotatably secured to the L-shaped bracket 12 and a bracket 14 which is secured to the top of the bracket 12 and mast M proper, (see FIGS. 17 and 18). For the purposes of fixing the mast M relative to the frame T, a tab 15, which is secured to the frame member TFL and the mast M, is provided. In order to secure the mast M and the frame element TFL together a securing bolt 16 is provided that extends between the two by means of the tab 15. The securing member 16 is fixed in position to hold the mast M to the frame TFL when the apparatus 10 is in the traveling position or the mast M is being lowered or extended.

Figure 10:
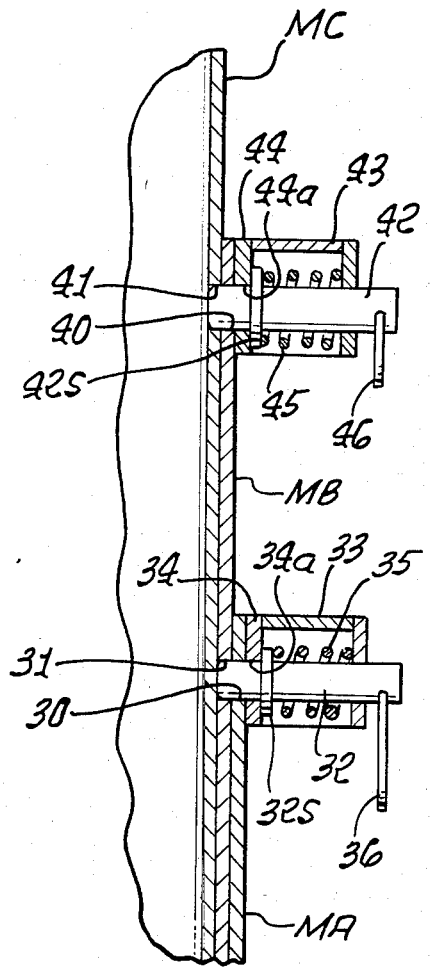
FIG. 10 is a partial view of the mast sections taken along the line 10—10 of FIG. 8.
Figure 11:
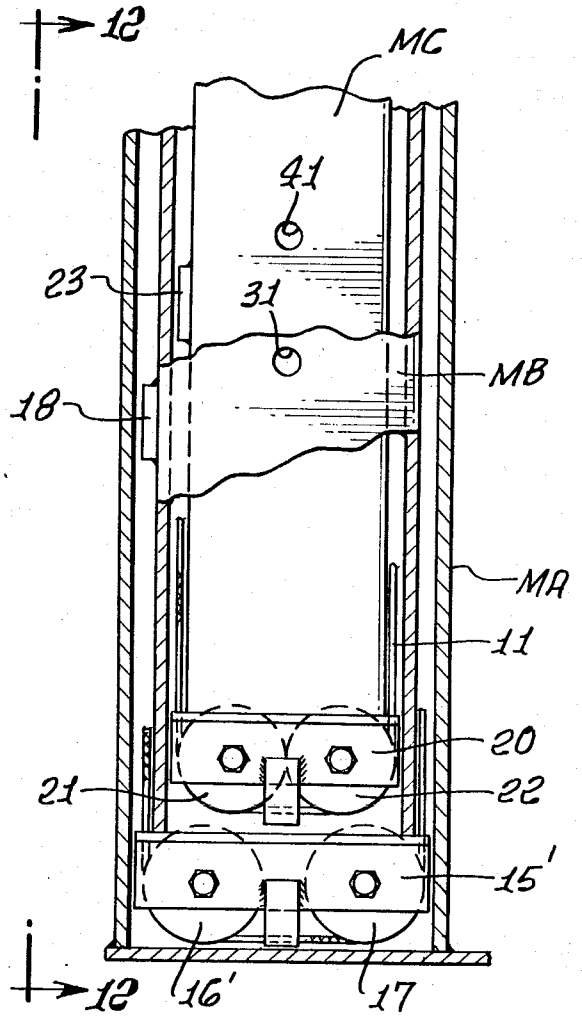
FIG. 11 is a partial, cross sectional view of the mast in a collapsed position corresponding to that illustrated in FIG. 2.

The mast M comprises a stationary section MA and two movable telescopic sections MB and MC slidable relative to one another. The mast section MA is rotatably secured to the frame T, as described hereinabove, and telescopically receives the slidable mast section MB. The mast section MC is telescopically received within the mast section MB; see FIG. 4 for example. The lower end of the mast section MB is provided with a bracket 15' for mounting a pair of spaced sheaves 16' and 17 for receiving the winch cable 11 coupled thereto; see FIG. 11. The shortening and lengthening of the cable 11 under the control of the winch-cable system WC correspondingly elevates and lowers the mast section MB. At a predetermined location on the mast section MA stops 18 are secured to the outside wall thereof for limiting the upward travel of the mast section MB, or the extension outside of mast section MA. The mast section MC is similarly defined as the mast section MB. For this purpose a sheave bracket 20 is secured to the bottom of the section and mounts a pair of sheaves 21 and 22 for coupling the winch cable 11 therearound and controlling the extensions and retractions of the mast section MC. The mast section MC also includes stop members 23 arranged on the outside wall thereof at a preselected location for arresting the upward travel of the mast section MC. Each of the mast sections MA, MB, and MC have a locking aperture for receiving a locking pin for locking each of the telescopic sections to one another in the retracted condition. The mast section MA is provided with an aperture 30 that is coaxial with the aperture 31 for receiving the locking pin 32. The locking pin 32 is slidably mounted to an L-shaped bracket 33 that is secured to an apertured plate 34 that is secured to the outside wall of the mast section MA. The plate 34 has an aperture **34*a* coaxial with the apertures 30 and 31. The pin 32 carries a shoulder 32S intermediate its ends for seating one end of the compression spring 35 between the seat 32S and the inside wall of the bracket 33, as illustrated in FIG. 10. The outer end of the locking pin 32 extends outwardly from the bracket 35 and carries a triangular handle 36 that is secured thereto for ease in withdrawing the locking pin 32 from the apertures 30 and 31 to allow relative movement between the mast sections MA and MB by means of the winch control system WC. A locking means is similarly provided for the mast sections MB and MC. For this purpose the mast section MB is provided with an aperture 40 which is coaxial with an aperture 41 in the mast section MC for receiving a locking pin 42. The locking pin 42 is similarly mounted with an L-shaped bracket 43 secured to an apertured plate 44, which is in turn secured to the outside wall of the mast section MB and having an aperture 44*a* for slidably receiving the locking pin 42. The locking pin 42 carries a shoulder 42S for seating one end of the compression spring 45 secured between the seat 42S and the inside wall of the bracket 43. The locking pin 42 also carries a triangular handle 46 secured thereto. When the locking pins 32 and 42 are arranged in the locking position, as illustrated in FIG. 10, the mast sections MA, MB and MC are locked in the collapsed position. After the mast sections MB and MC have been extended and are retracted to their collapsed positions, the springs 35 and 45** will automatically snap-lock into their respective locking apertures due to the release of the respective compression springs.

Figure 9:
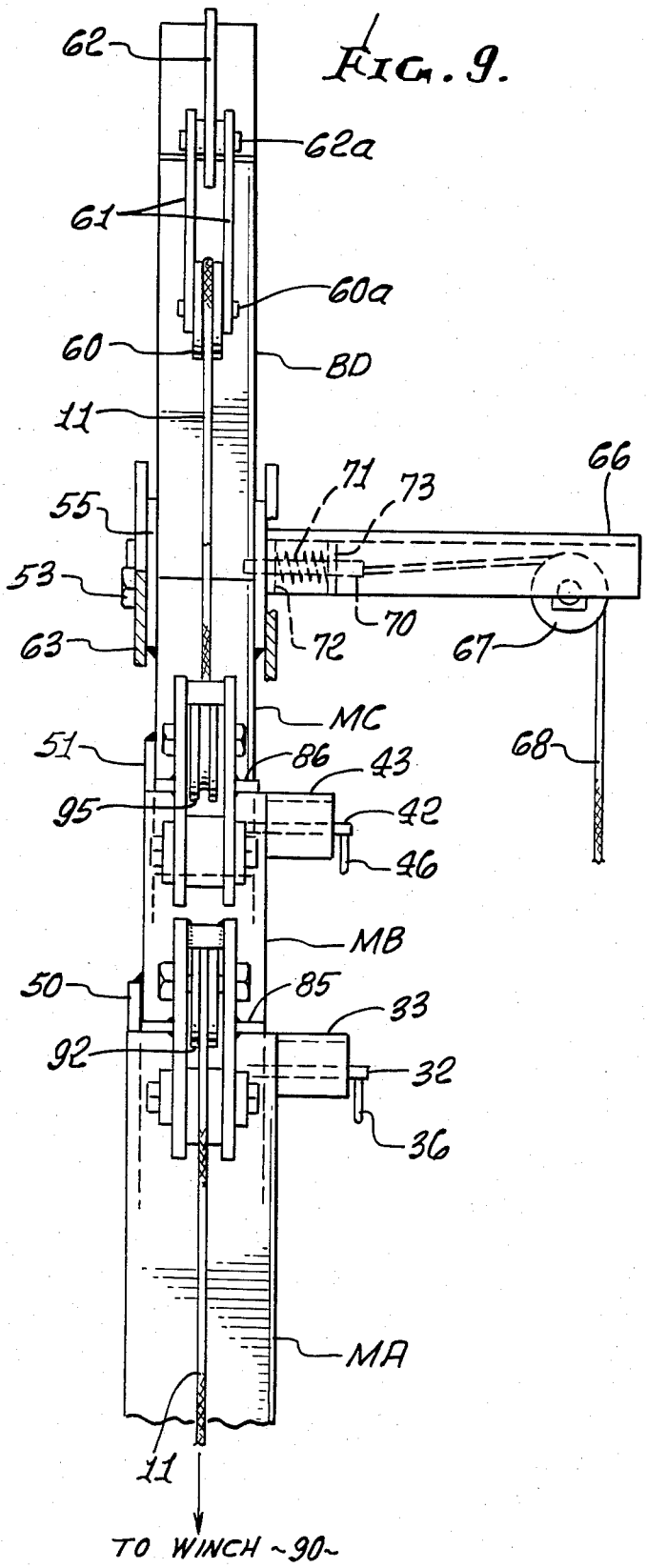
FIG. 9 is a view of the mast and boom taken along the line 9—9 of FIG. 8.

To control the downward travel of the mast sections MB and MC, each section carries a downstop on the outside surface thereof. The mast section MB carries a downstop 50 on the outside surface thereof and dependent therefrom for abutting the top surface of the mast section MA to arrest the downward travel of the section MB within the section MA, as illustrated in FIG. 9. At that time the locking pin 32 will automatically lock the sections MA and MB together. Similarly, a downstop 51 is provided for the mast section MC and is carried on the outside surface thereof and dependent therefrom to abut the top surface of the mast section MB to arrest the downward travel of the telescoping mast section MC within the section MB. When the the downward travel of the mast section MC is stopped, the lock pin 42 will automatically lock at that position. The downward travel of the mast sections MB and MC is controlled by the cable-winch system WC, as will be explained more fully hereinafter.

The boom B is also constructed of a section of a predetermined, fixed length, identified as the section BD, with two telescoping sections arranged therewith.

Figure 7:
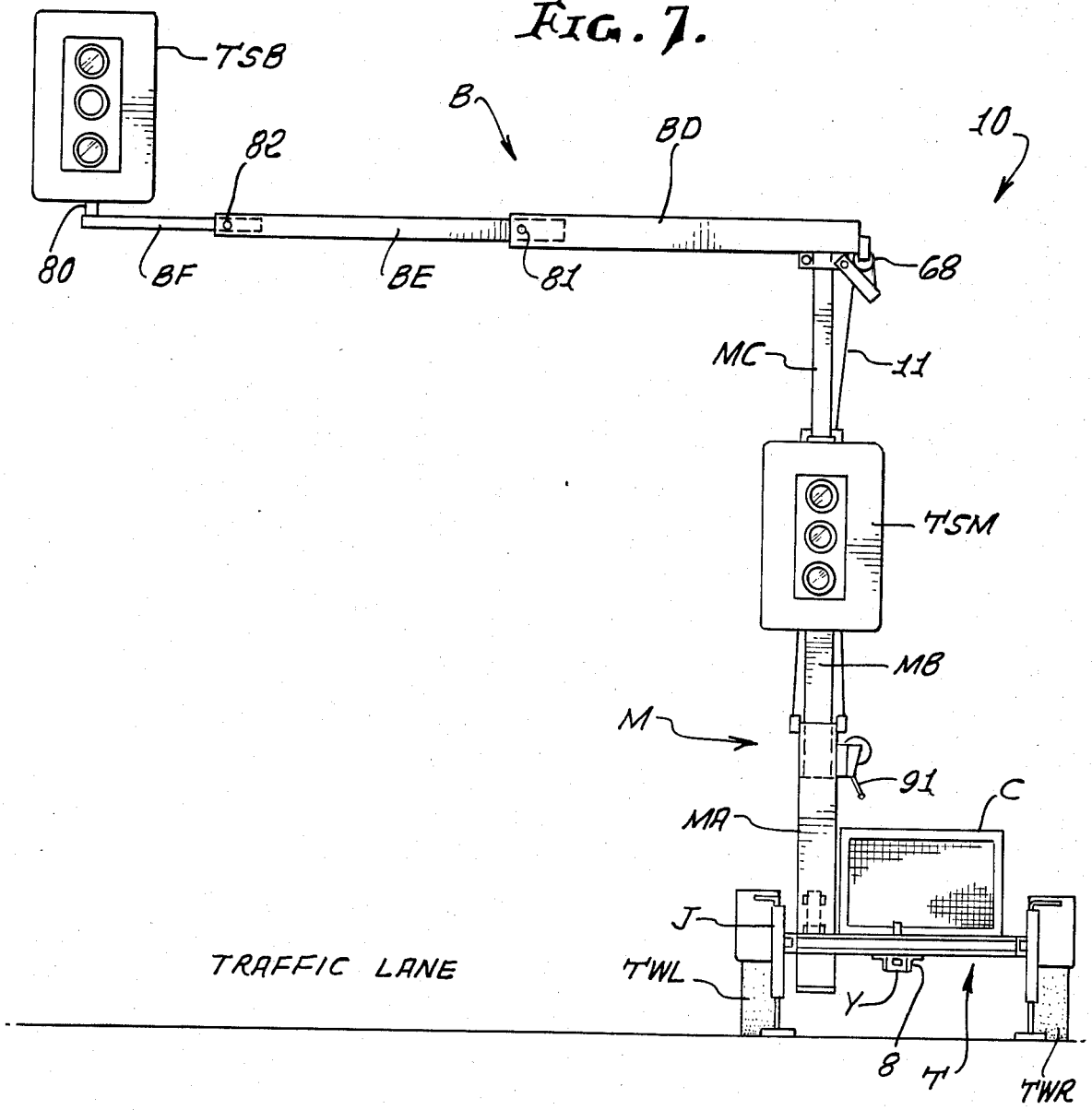
FIG. 7 is a rear elevational view of the traffic apparatus taken along the line 7—7 of FIG. 6.
Figure 14:
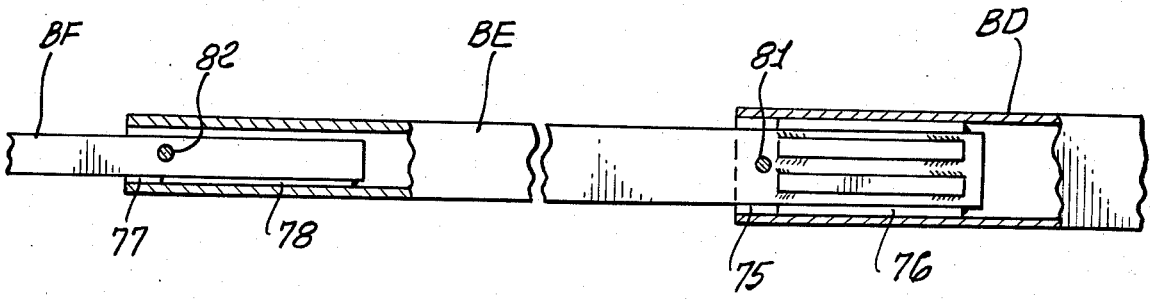
FIG. 14 is a partial, cross sectional and elevational view of the boom in its telescopically extended position as illustrated in FIG. 7.
Figure 8:
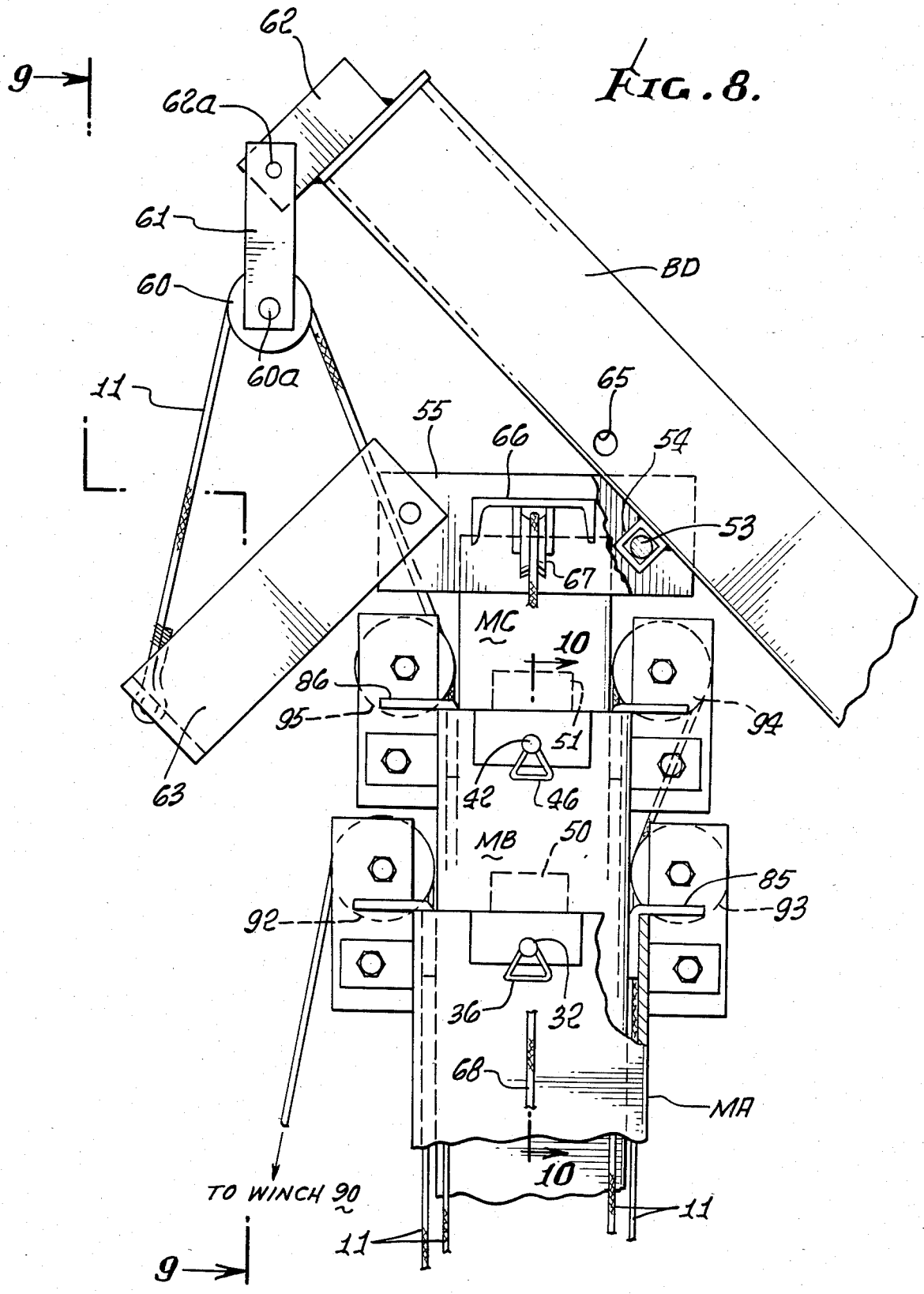
FIG. 8 is a partial, enlarged view, with portions shown in section, of the mast and the boom arranged in the completely collapsed condition corresponding to their arrangement in FIG. 2.

The first telescoping section is identified as the telescoping section BE with the second telescoping section being identified as the section BF; see FIGS. 7 and 14 for example. The telescoping section BE is slidably received within the section BD, while the boom section BF is slidably received within the boom section BE. The telescopic sections BE and BF for the boom B are constructed and defined in accordance with the present invention to be extended and collapsed in unison with the controlled extensions and retractions of the mast sections MB and MC . The boom section BD is pivotally secured to the mast section MC through the provision of a pivot pin 53 enclosed within a housing 54 that is secured to the inner outside surface of the boom member BD. The mast element MC carries a bracket 55 on the top side thereof to which the pivot pin 53 is secured for pivotal movement in accordance with the movements of the mast M. The outer end of the boom member BD as illustrated in FIGS. 8 and 9 secures a pulley 60 for controlling the movements of the boom B along with the controlled movements of the mast M by means of the cable 11. The pulley 60 is suspended between a pair of brackets 61 by means of a pin 60*a* that mounts the pulley 60. The brackets 61 are in turn suspended from a mounting plate 62 to which they are secured to the end of the boom section BD.

Figure 19:
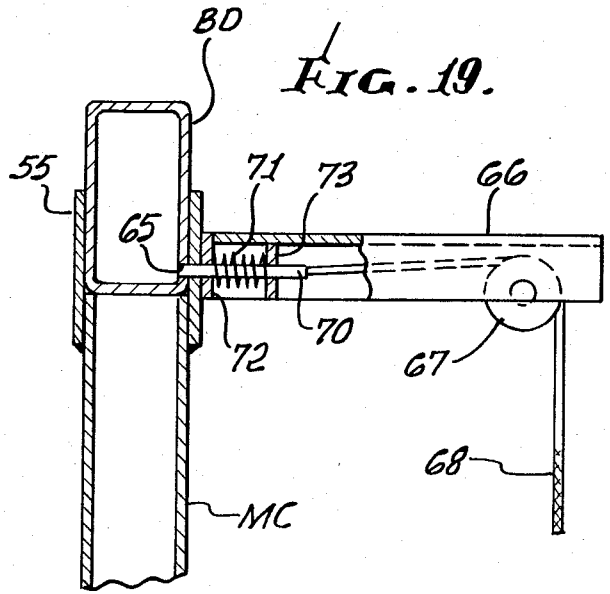
FIG. 19 is a partial, sectional view, taken along the line 19—19 of FIG. 5, illustrating the locking of the boom to the mast.

The brackets 61 are mounted to the pin 62*a* that is secured to the mounting plate 62. The mounting plate 62 is secured to the end of the boom section BD and extends outwardly therefrom (see FIG. 8). The free end of the winch cable 11 is received from the mast section MC and is coupled around the pulley 60 and has its free end secured to a bracket 63 angularly secured to the bracket 55 at the end of the mast section MC to be movable with the mast section MC. The boom member BD is provided with a locking aperture 65 for securing the boom B in a horizontal position relative to the mast M. For this purpose the mast section MC secures a bracket member at the plate 55. The bracket member 66 extends outwardly from section MC and mounts a pulley 67 adjacent the free end thereof; see FIG. 19. The pulley 67 couples a release cable 68 that is secured to the end of a locking pin 70 for locking the sections MC and BD together. The release pin 70 carries a compression spring 71 and is seated at its inner end to an apertured plate 72. The pin 70 is suitably slidably received by an apertured bracket 73, which forms the remaining seat for the spring 71. The apertures for the elements 55, 72, and 73 are coaxial with the locking aperture 65 when arranged as in FIG. 19. Accordingly, pin 70 is in a fixed relationship with regard to the mast section MC and will automatically lock into the locking aperture 65 provided in the boom section BD when it is moved to a horizontal position. In order to release the horizontal position of the boom B, in particular the boom element BD, the cable 68 is pulled downwardly by the operator to withdraw the locking pin 70 outwardly from the locking aperture 65. This permits the boom B to descend from its horizontal position a slight distance and it is then under the control of the winch cable system WC for controlling its downward travel.

The relationship of the boom B can best be appreciated by examining FIG. 14 wherein the boom sections are shown in their extended, horizontal relationship. The free end or the open end of the boom section BD is provided with a stop member 75 to arrest the outward extension of the boom section BE. For this purpose the boom section BE carries a shim 76 secured around its outer surface adjacent its inner end so as to abut the stop member 75 when it is extended outwardly of section BD and thereby arrest the travel of the boom section BE outside of the boom section BD. Similarly, the boom section BE is provided with a stop member 77 secured adjacent its open end and the boom section BF carries a shim 78 on its inner end so as to about the stop member 77 when the section BF is extended from the section BE. This limits the outer extension of the boom section BF from the boom section BE. For safety purposes, once the boom sections BE and BF have been fully extended, manual lock pins may be provided to secure the outward extension of the sections BE and BF as they rest adjacent the stop members 75 and 77. For this purpose a stop pin 81 is provided for locking the members BE and BD together while the stop pin 82 is provided for locking the position of the boom members BE and BF together. The locking pins 81 and 82 may be secured to the boom adjacent the ends of the boom sections to be readily available to the operator. The boom section BF is also provided with a telescopic mount 80 adjacent the end thereof to mount the traffic signal TSB; see FIG. 7. The traffic signal TSB is slidably received within the mount 80 so as to be temporarily secured thereto for display purposes. The mount 80 may be apertured to secure a locking pin LP manually inserted for securing the stem of the light TSB. For this purpose the stem S is provided with an aperture for receiving the locking pin LP in the manner illustrated in FIG. 15.

Figure 13:
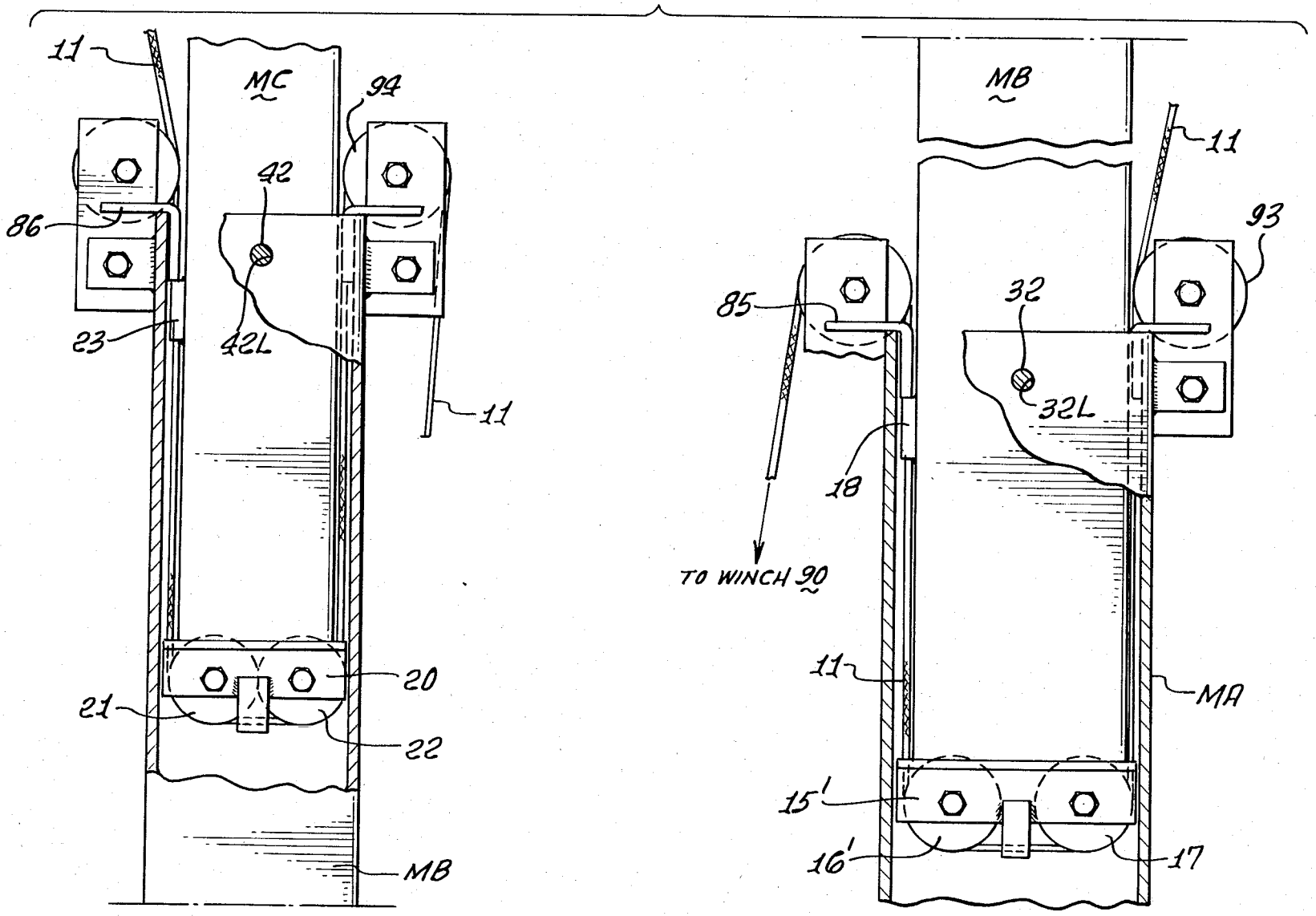
FIG. 13 is a cross sectional view, with portions shown in elevation, of the portions of the mast when arranged in a fully elevated position and the two portions arranged together as indicated.

The mast M is illustrated in FIG. 13 when the mast sections MB and MC are fully extended. This relationship can be appreciated when the left hand portion of the drawing illustrating the mast sections MB and MC are considered as being positioned over the corresponding portion of the mast sections MA and MB on the right hand side of the drawing. The mast section MB is extended outwardly from the mast section MA, under the control of the winch-cable system WC, until it is withdrawn to the point where the upstop elements 18 engage the L-shaped stop element 85. Similarly, the mast section MC is withdrawn from the mast section MB until the stop members 23 engage the upstop member 86 which is also in the form of an L-shaped member. Once the upward travel of the mast section MB is arrested, the alignment of sections MA and MB is such that the locking pin 32 is automatically inserted into the locking aperture 30 and 31 due to the compressed spring 35 being released for locking these two mast sections in their extended positions. Similarly, when the upward travel of the mast section MC is arrested, the compressed spring 45 moves the locking pin 42 into the locking apertures 40 and 41 for locking mast sections MB and MC in their extended positions.

The winch-cable system WS includes a winch 90 which has the winch cable 11 secured to it at one end and is operated by rotating the handle 91 clockwise or counter-clockwise. The rotation of the handle 91 in a clockwise direction winds up the winch cable 11 on the winch 90 to shorten the length of cable extending outwardly from the winch 90 and thereby extend the telescopic sections. Alternatively, the counterclockwise rotation of the winch hand 91 will pay out the winch cable 11 so as to control the apparatus in the reverse direction, or to allow the telescopic sections to collapse into their retracted positions. The winch cable 11 is coupled from the winch 90 around the sheave 92 secured adjacent the upper end of the mast section MA, as illustrated in FIG. 8. The winch cable 11 is coupled around the sheave 92 in a clockwise direction and extends downwardly therefrom between the mast sections MA and MB to be coupled around the sheave 16' and from there to the sheave 17; see FIG. 11. The winch cable 11 is coupled upwardly from the sheave 17, between the sections MA and MB, to be coupled around the sheave 93 in a clockwise direction so as to allow it to be coupled around the upper sheave 94 mounted at the outer extremity of the mast section MB and secured thereto; see FIG. 8. The winch cable 11 is coupled around the sheave 94 in a counterclockwise direction and is then positioned to travel downwardly between the mast sections MB and MC so as to be coupled to the sheave 20 arranged at the bottom of section MC, and then moved laterally to the left hand sheave 21; see FIG. 11. The winch cable 11 is coupled upwardly from the sheave 21 to be coupled to the sheave 95 secured to the opposite side of the mast section MB from the sheave 94. The winch cable 11 then is coupled from the sheave 95 around a pulley 60 for the boom B and downwardly therefrom in a counterclockwise direction so as to have its free end secured to the plate 63; see FIG. 8. The lengthening or shortening of the winch cable 11 controls not only the extensions and retractions of the mast sections MB and MC but also the corresponding actions are provided to the boom sections BE and BF in unison therewith, as will be described hereinafter.

Figure 15:
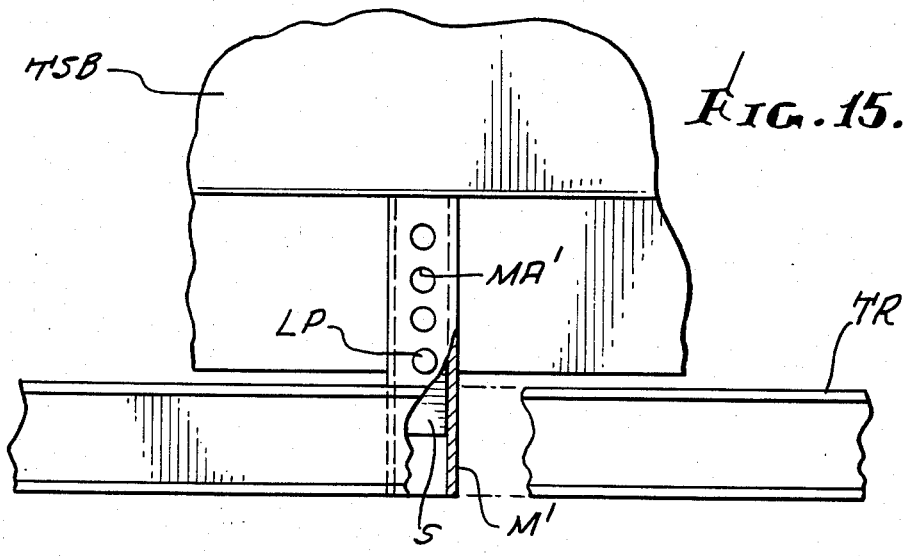
FIG. 15 is a cross sectional view, with portions in elevation, taken along the line 15—15 of FIG. 3 illustrating the manner of mounting a traffic signal to the supporting structure.

The traffic signal TSM is permanently secured by means of a suitable bracket and fastener 100 to the mast section MB to be movable in unison therewith, as best illustrated in FIG. 6. The traffic signal TSB for the boom B is arranged to be temporarily mounted on the boom section BE by means of the mount 80 (as explained hereinabove) and when not mounted on the boom is stored on the supporting structure for the trailer T. For this purpose the trailer T is constructed and defined so that the rear bracket TR has a mounting socket M' secured thereto that is adapted for slidably receiving the stem S for the traffic signal TSB. The traffic signals TSB are conventionally constructed with an apertured stem S so as to be mounted in a corresponding female member. The mount M' is provided for this purpose and is constructed and defined to include a plurality of spaced apart apertures MA' that permit the signal TSB to be locked to the mount M'. For this purpose a locking pin LP can be manually inserted into the aperture MA' for the mount M' to be received in the coaxially aligned locking aperture in the stem S for the traffic signal TSB. This corresponds to the transit position of the traffic signal TSB and is illustrated in FIG. 15. The traffic signal TSB can be readily removed from the mount M' by removing the locking pin LP and mounting it in the same manner to the corresponding socket 80 on the boom section BF when the apparatus 10 is to be erected at a site requiring traffic control.

When the traffic signal TSB is stored on the trailer T for transit purposes, the end of the boom B or the boom section BF which carries the traffic signal mount 80 is secured to the trailer T. For this purpose a bracket 101 is secured to the side frame member TFL of the trailer T for securing the light mount 80. The securing bracket 101 includes a locking aperture for receiving a locking pin LP that secures the mount 80 to the bracket 101. This is accomplished by manually inserting a pin 102 through the locking aperture in the bracket 101 coaxially with the locking aperture for the mount 80 to lock it to the boom, as illustrated in FIGS. 2 and 3.

The mast M is normally positioned in a vertical position during transit and after the telescopic sections have been extended. As explained hereinabove, the mast M may be rotated through ninety degrees to display the traffic signals TSB and TSM. For this purpose, a handle 105 is pivotally secured adjacent its bottom end to a pivot pin 106 for securing it to the mast section MA. The handle 105 may be releasably secured to the mast section MA at its free end by means of a locking pin 107 manually secured thereto, as illustrated in FIG. 3. In order to rotate the mast MA, the locking member 16 which locks the mast to the frame T must first be removed. When this locking member 16 is removed, the handle 105 may be disengaged from the mast MA by removing the locking pin 107 and pulled outwardly to allow the mast MA to be rotated; see FIG. 6. Once the mast M is rotated through ninety degrees it is locked to the trailer frame T. For this purpose the handle 105 is locked through the provision of a pair of upstanding members 110 adapted to receive the handle 105 therebetween, as illustrated in FIG. 16. The aperture for securing the handle 105 to the mast section MA is utilized with a locking pin 111 to secure the handle 105 to the plates 110 to lock the rotated mast M in the traffic signal display position illustrated in FIG. 6.

With the above structure in mind, the operation involved in erecting the traffic apparatus 10 and collapsing it back to a storage position will now be described. Initially, it will be assumed that the apparatus 10 is in its storage position, such as illustrated in FIG. 2. In this condition, the mast MA is secured to the trailer frame T by the locking element 16, as is the rotating arm 105 secured by the locking pin 107 to the mast section MA. The mast sections MB and MC are both in their collapsed condition as illustrated, as are the boom sections BE and BF. The boom section BF is secured to the securing means 101 to maintain the boom B in position. Accordingly, at this time the boom traffic signal TSB is mounted in the mounting member M' on the frame member TR. The stabilizing jacks J are manually operated to elevate the jack feet JF above the ground level to allow the trailer T to be towed. In this condition the yoke Y can be hitched to a motor vehicle by means of the hitch H and transported to a point where traffic control is necessary.

Assume now that the apparatus 10 has been transported to a position adjacent a traffic lane and is to be set up for traffic control purposes. The apparatus 10 is detached from the motor vehicle after the trailer T is positioned adjacent the roadside and out of the traffic flow in the manner illustrated in FIG. 1. The stabilizing jacks J are then dropped to cause the jack feet JF to engage the ground for stabilizing the apparatus 10. In order to extend the telescoping sections, the safety pins 81 and 82 securing the boom sections in position are initially removed. In addition, the locking pin 42 is released by pulling out on the handle 46 to release the locked mast sections MB and MC. This permits the mast section MC to be extended outwardly from the mast section MB. This is accomplished by winding the winch handle 91 in a clockwise direction to cause the cable 11 to be wound on the winch 90 to gradually lift the mast section MC out of the mast section MB as a result of the lifting action provided by the winch cable 11 at the sheaves 21 and 22 as a result of the shortening of the winch cable 11 through the continuous operation of the winch handle 91. This action continues until the mast section MC is moved upwardly to a point where the upstop 23 engages the stopping members 86, as illustrated in the left hand side of FIG. 13. At this time the locking pin 42 is automatically moved into the locking aperture 42L to lock the mast sections MB and MC in their extended positions. After this has occurred, the mast section B can then be extended out of the mast section MA. To initiate this operation, the pin 32 must be released by pulling on the handle 36 to release the mast section MB from the mast section MA. When this releasing operation has been performed and with the continuous operation of the winch crank 91 continuously shortening the cable 11 so that the lifting force provided to the mast section MB through the sheaves 16' and 17 continuously raises the mast section MB upwardly along with the extended mast section MC. Once the mast section MB has been raised to the point where the stop members 18 engage the stop 85, the mast section will have reached its upper extremity. At this time the spring loaded latch pin 32 will be urged into engagement with the coaxially arranged locking apertures 32L to lock the mast sections MA and MB together as the mast sections MB and MC were latched together by the latch pin 42.

It should be understood at this point that as a result of the boom B being pivotally coupled at one end to the mast M and secured to the securing means 101 at is opposite end that the elevation of the mast sections MB and MC is effective for extending the boom sections BE and BF relative to the boom section BD as they are free to slide.

Figure 4:
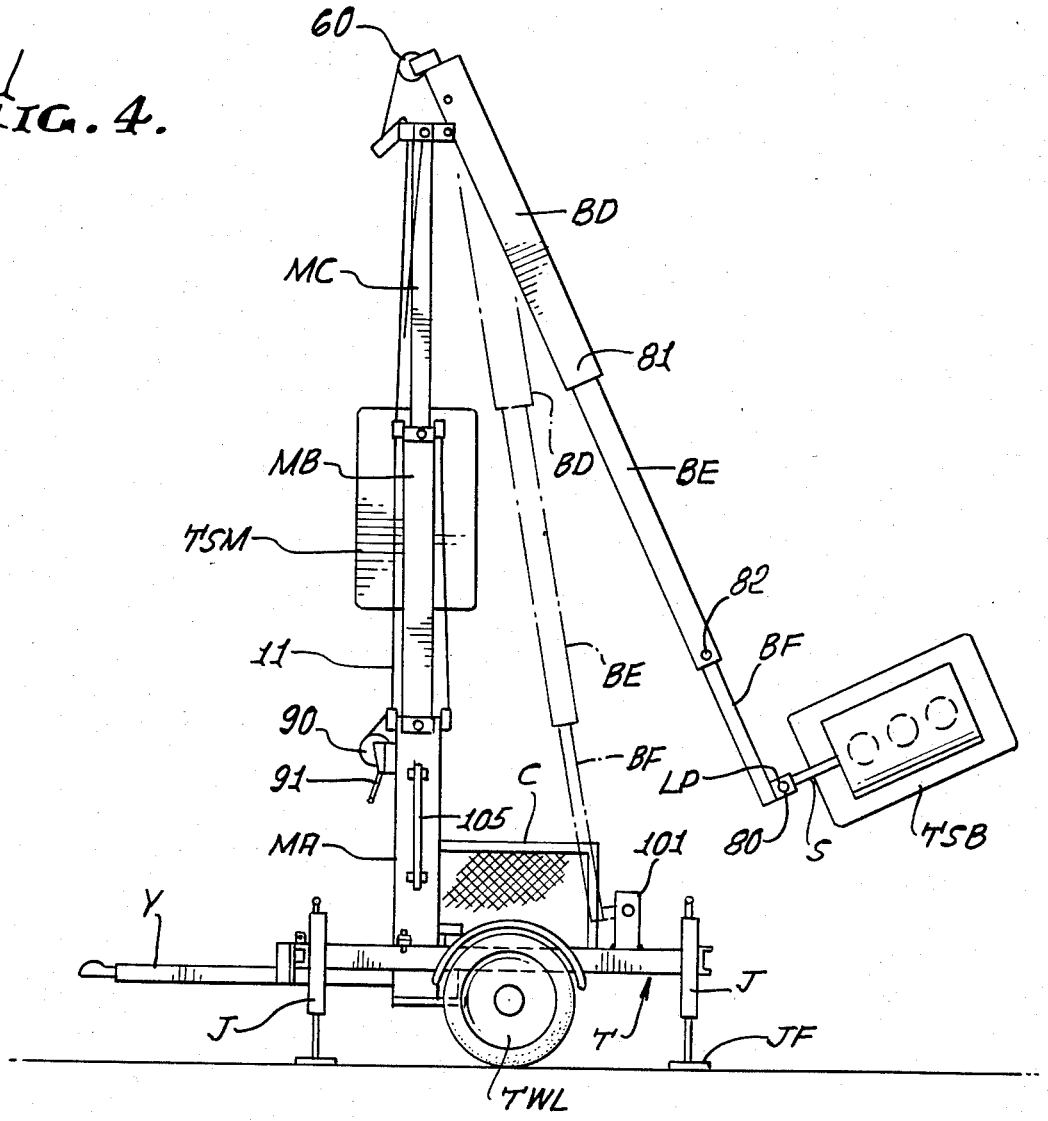
FIG. 4 is a side elevational view, similar to FIG. 3, with the mast and boom fully extended and the boom released from the supporting structure and having the traffic signal mounted thereon, the fully extended position of the boom when secured to the trailerd supporting structure is illustrated in dotted outline.

In the arrangement of the apparatus 10, as illustrated in FIG. 3, as the mast section MC is extended from the mast section MB, it will result in the boom section BE being extended from the boom section BD as a result of the pulling forces created at the boom section BD due to the elevation forces that have been imparted to the mast section MC. Similarly, with the extension of the mast section MB the boom B will be further elevated to the point where the boom section BE will be fully extended and its outward travel will be arrested by the stop member 75. At this same time the boom section BF will have been extended out of the boom section BE, but not for its full travel. This latter arrangement is illustrated in FIG. 4 in dotted outline and showing the condition of the boom sections while still secured to the trailer frame. It should be understood that the sequential elevation of the mast sections MC and MB causes the simultaneous extensions of the boom sections BE and BF so that the extensions of the mast sections and boom sections is in unison.

Once the mast M and the boom B have been fully extended, as described hereinabove, the end of the boom B or the boom section BF can be released from the securing means 101. Since at this time the boom B is under tension, the boom will swing in a counterclockwise direction outwardly away from the securing means 101 to a position corresponding to the position illustrated in solid lines in FIG. 4. At this time the boom section BF can be futher manually extended until the shim 78 carried by the boom section BF comes to rest at the stop member 77. At this time the boom traffic signal TSB can be detached from the trailer T. For this purpose the lock pin LP is removed from the mount M' and the traffic signal TSB is slidably lifted from the mount. The traffic signal TSB may then be similarly mounted at the mounting element 80 for the boom section BF and secured in position by a manual locking pin, as described hereinabove. At this time the locking pins 81 and 82 are manually positioned at the boom sections to lock the boom sections BF and BE in their extended positions before the boom B is further elevated; see FIG. 14. When this has been achieved, the boom B is in a position to be swung upwardly to a horizontal relationship with respect to the vertical mast M. This is accomplished by the continuous clockwise rotation of the winch arm 91 to further shorten the winch cable 11 so as to cause a pivoting force to be applied to the boom B through the pulley 60 and its associated elements coupled to the boom section BD; see FIG. 8. The continuous rotation of the winch 90 occurs until the boom B assumes a horizontal position and is then automatically locked in place in that position. For this purpose the lock pin 70 which is mounted with the compression spring 71 during this time will then automatically pass through the locking aperture 65 provided for the boom section BD to lock the boom B and mast M together with the boom arranged in a horizontal position. This position of the apparatus 10 is illustrated in FIG. 5. As illustrated in FIG. 5 the apparatus 10 is arranged so that the boom B will be essentially aligned parallel with the traffic lane and the traffic signals TSM and TSB would not be displayed to a motorist traveling in the traffic lane. To complete the erection of the apparatus 10, the handle 105 is disengaged from the mast section MA and pivoted away therefrom. At the same time, the mast section MA is released from the trailer T by releasing the securing member 16. This conditions the mast M to be rotated through ninety degrees and thereby the boom to be rotated ninety degrees over the traffic lane without any danger to the motor vehicles passing in the traffic lane. To accomplish this, the disengaged arm 105 is grasped by the operator and rotates the mast through ninety degrees about the pivot pin 13. When the rotation of the mast M is completed, the handle 105 is secured to the trailer T by means of the locking pin 111 to the securing members 110. This condition of the apparatus 10 is illustrated in FIGS. 6 and 7. In FIG. 7 it will be noted that the traffic signals TSM and TSB will be forward of the approaching motor vehicles so as to be clearly visible from a motor vehicle to the motor vehicle operator. With all of the telescoping sections locked in position and the mast M locked to the frame T, the apparatus 10 is secure to be left for traffic control operations. The traffic signals, of course, will have been electrically connected up with the power source within the cage C to allow the signals to be conventionally operated.

Once the need for the temporary traffic control is alleviated and there is no further need for the apparatus 10 at the particular location, it can be collapsed back to the storage condition illustrated in FIG. 2. To place the elements of the apparatus 10 back in a storage condition, it is necessary first to again rotate the mast M through ninety degrees so that the traffic signals TSB and TSM will be swung out of the traffic lane back to the position illustrated in FIG. 5. This allows the traffic to proceed normally and the rotation of the boom B out of the traffic lane will not interfere with the traffic therein. This is accomplished by releasing the arm 105 from the securing members 110 to allow it to again be grasped and rotate the mast M back to the storage position. After the arm 105 has rotated the mast M through the ninety degrees, the arm then is rotated upwardly to secure it to the mast section MA. The mast M may also be secured to the trailer frame T at this time by replacing the securing member 16. To lower the boom B it is first necessary to pull on the release cable 68. The pulling of the release cable 68 provides a lateral force to the latch pin 70 through the pulley 67 to release the pin from its corresponding locking aperture 65. This causes the boom B to descend a small distance due to gravity. The winch handle 91 can now be rotated in a counterclockwise direction to cause the winch cable 11 to be lengthened. The lengthening of the winch cable 11 about the pulley 60 allows the boom B to slowly descend as the cable 11 is payed out from the winch 90. This causes the boom B to swing in a clockwise direction until it assumes a position similar to that illustrated in FIG. 4. At that time, the traffic signal TSB is at an elevation that it can be removed from the mount 80 by the operator. The locking pin, then, is removed from the mount 80 and the traffic signal TSB removed from the boom section BF. The traffic signal TSB is then positioned on the trailer T at the mount M', as illustrated in FIG. 15. The locking pin 82 is removed to release boom sections BE and BF. The boom section BF may now be pushed manually a short distance inside the boom section BE to provide the appropriate length for securing the section BF to the trailer securing element 101. Once this is accomplished, the boom section BF is again secured by the pin 82 and then the section BF is secured to the member 101. The pin 82 is again removed. The winch 90 can be operated, once again, to cause the sections of the mast M and boom B to be telescopically collapsed. To inititate this collapsing of the telescopic sections, the locking pin 32 is withdrawn from its locking aperture 32L to allow the mast section MB to be collapsed within the mast section MA. This results through the paying out of the winch cable 11 so that it slowly releases the forces at the sheaves 16' and 17 to allow the mast section MB to travel downwardly under the control of the winch cable 11 until the mast section MB has its downstop 50 in engagement with the top surface of the mast section MA. At this time the lock pin 32 will automatically move into the locking aperture 31 for the mast MB to secure the mast sections MA and MB in this collapsed condition. During this time interval the boom section BF is telescopically retracted within the boom section BE; see FIG. 3.

The next step in the procedure is to release the latch pin 42 from the locking aperture 42L and the locking pin 81 from the boom sections BE and BD. The release of these pins allows the mast section MC and boom section BE to be collapsed. The same movement occurs as when the mast section MB and boom section BF were retracted as a result of the continuous rotation of the crank arm 91 to pay out the winch cable 11. With this operation, the mast section MC will travel downwardly until its downstop 51 engages the top surface of the mast section MB. At this time the latch pin 42 will automatically be moved by its compression spring 45 to latch it to the aperture 41 and thereby the two collapsed sections MB and MC together. During the collapsing procedure for the mast sections MB and MC, the collapsing forces cause the boom section BE to be forced into the boom section BD to assume the position illustrated in FIG. 2. The jacks J have their feet JF elevated from the ground.

With this operation completed, a motor vehicle may then be pulled up to the hitch H, coupled to the hitch, and the apparatus 10 hauled to the next location requiring traffic control.

It should be noted that, as a result of the above operation, the important aspect of telescoping the mast and boom sections is that the sections are telescoped and expanded without any significant load thereon. To this end the traffic signal TSB is not loaded at the end of the boom so as to cause the bending loads to exist during these operations. The fact that the boom end is secured during this operation allows a single which cable system WC to control both the mast M and the boom B during both expansion and collapsing operations with a minimum of effort. The capability of erecting the apparatus 10 alongside a traffic lane as described allows it to be erected under traffic conditions and merely swung over a traffic lane without danger to the operators of the apparatus 10 or the passing motor vehicles, or the drivers thereof.

The apparatus 10 may be utilized in an area subject to high winds. The high winds can cause the apparatus 10 to tip over if the wind velocity is high enough or if the surface on which the jacks J engage a surface that has sand or the like thereon, the winds can cause the apparatus to slide around the feet JF of the jacks J. The feet JF are constructed of a metallic material when the jacks J are commercially available devices. The tipping over of the apparatus 10 can be minimized for normal wind velocities (below approximately 87 miles per hour) by adding a ballast to the trailer such as a water ballast or the like to further stabilize the apparatus 10.

Figure 20:
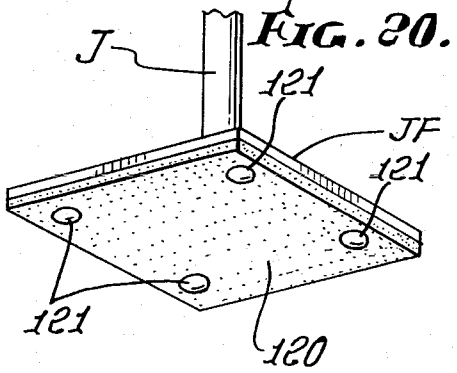
FIG. 20 is a partial perspective view of the bottom of the mounting feet for the stabilizing jacks having friction material secured thereto.
Figure 12:
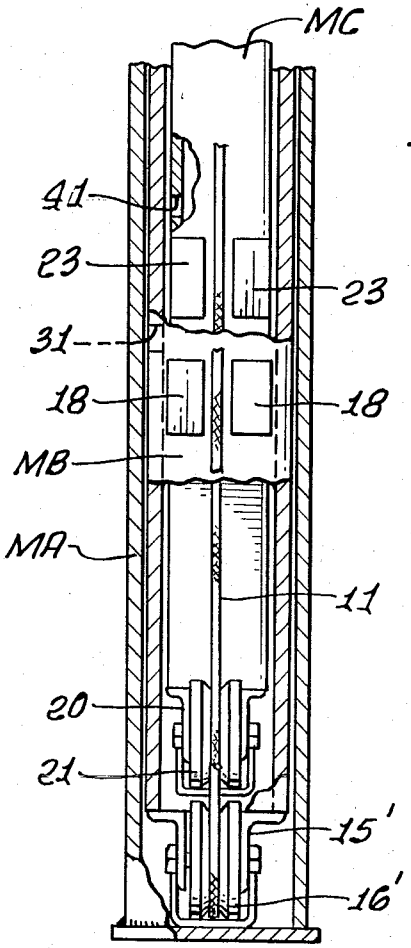
FIG. 12 is a cross sectional view taken along the line 12—12 of FIG. 11.

The use of a metallic material for the jack feet JF and a low coefficient of friction between the supporting surface and the jack feet JF may result in the apparatus 10 sliding around the supporting surface due to the winds. Wind velocities as low as 29 miles per hour for an unbalasted trailer can cause this sliding or "weathervaning" when sand is on the supporting surface. This problem can be minimized by increasing the coefficient of friction between the jack feet JF and the supporting surface. If the jack feet JF are provided with a friction material such as when a rubber material 120 is secured to the bottom of the jack feet by rivets 121 or the like to completely cover the metallic feet JF, the skidding due to wind can be minimized; see FIG. 20. The wind velocity that will produce the skidding will be extended to approximately 77 miles per hour without any ballast and higher when ballasted.

I claim:

1. A portable traffic signal comprising a supporting structure of the wheeled trailer type, telescopic mast means having a plurality of telescopic sections slidable inside another section to be controllably moved between telescopically extended positions and telescopically collapsed positions, one end of the telescopic mast means being secured to said supporting structure to permit the remaining sections to be extendable and collapsible relative to said supporting structure, means for releasably securing the telescopic sections in either the extended or collapsed positions, telescopic boom means having a plurality of telescopic sections slidable inside another section to be controllably moved between extended positions and collapsed positions, one end of the telescopic boom means being pivotally secured adjacent to the free end of said mast means to permit the telescopic boom sections to be extendable and collapsible in unison with the movements of the telescopic sections for said mast means, the free end of the boom means being adapted to mount a traffic signal thereon, means on said supporting structure for releasably securing the free end of said boom means, and control means coupled to said mast means and said boom means to selectively move said plurality of telescopic sections between extended and collapsed positions in unison when said boom means is secured to said boom securing means.

2. A portable traffic signal as defined in claim 1 wherein said control means is further characterized as being selectively controllable to pivotably swing the extended boom means about said mast means to position the boom means between a traffic signalling position and a position adjacent said securing means when said boom means has been released from the securing means for said boom means, and means carried by said boom means for releasably securing the boom means in the traffic signalling position.

3. A portable traffic signal as defined in claim 2 including traffic signalling means adapted to be releasably secured to the free end of the boom means to be movable therewith, and means carried by said supporting structure for releasably mounting the traffic signalling means.

4. A portable traffic signal as defined in claim 1 or 2 including traffic signalling means secured to a preselected one of the telescopic sections for the mast means to be movable in unison therewith.

5. A portable traffic signal as defined in claim 2 wherein said mast means is rotatably secured to said supporting structure and including means pivotably secured to said mast means for selectively rotating the mast means between a traffic signalling position over a traffic lane and a position alongside the traffic lane.

6. A portable traffic signal as defined in claim 5 including means carried by said supporting structure for releasably securing said mast rotating means for securing same thereto when the mast means has been rotated to said traffic signalling position.

7. A portable traffic signal as defined in claim 5 including means for stabilizing the supporting structure.

8. A portable traffic signal as defined in claim 7 wherein said stabilizing means comprises stabilizing members having mounting feet engaging the ground, the mounting feet having friction elements secured thereto.

9. A portable traffic signal as defined in claim 1 wherein said telescopic mast means includes a stationary mast section for receiving a first telescopic mast section therein, said first telescopic mast section carrying sheave means adjacent one end thereof, a second telescopic mast section receivable within said first mast section, said second telescopic mast section carrying sheave means adjacent one end thereof, boom pulley means secured adjacent said one end of said boom means, said control means comprising a controllable winch-cable system secured to said mast means and having the cable coupled from the winch to said sheave means for said mast means and said boom means and to said boom pulley means with the end of the cable being secured adjacent the end of said second mast section for imparting telescopic extension and collapsing forces to the telescopic sections of said mast and boom in response to the alternate rotations of the winch causing the shortening and lengthening of the length of cable from the winch to uniformly extend and collapse said mast and boom sections when the free end of said boom means is secured and to swing said boom means about said pivot between an unsecured position and a traffic signal display position in response to the rotation of the winch when the boom means is free to swing through the pivoting forces imparted by means of the boom pulley means, and means for releasably securing the boom means at said traffic signal display position.

10. A portable traffic signal as defined in claim 9 including means secured to said supporting structure for stabilizing the portable traffic signal including when the boom means is secured in the traffic signal display position.

11. A portable traffic signal as defined on claim 9 including a traffic signal mounted to said free end of the boom means when it is released from the supporting structure and releasable therefrom, said traffic signal being swingable with the boom means in response to the winding and unwinding of the cable from the winch.

12. In a portable traffic signal having a supporting structure, telescopic mast means carried by the supporting structure and adapted to be controlled between telescopically extended and collapsed positions, telescopic boom means pivotally secured to said mast means and adapted to be controlled between telescopically extended and collapsed positions, means carried by the supporting structure for releasably securing the free end of the boom means, and control means coupled to said mast means and said boom means to selectively telescopically extend and collapse said mast means and said boom means in unison when the boom means is secured to said boom securing means.

13. A portable traffic signal as defined in claim 12 including traffic signalling means mounted adjacent to the free end of the boom means when the boom means is released from the supporting structure, the control means being further operative to swing the released, extended boom means and said traffic signalling means about the extended mast means between a traffic signal display position and a position adjacent said boom means securing means.

14. A portable traffic signal as defined in claim 13 wherein the telescopic mast means is rotatably secured to said supporting structure and said mast means releasably carries means for rotating the mast means and thereby the extended boom means over a preselected traffic area to display the traffic signal means.

15. A portable traffic signal as defined in claim 14 including means secured to said supporting structure for stabilizing same including during the intervals the boom means is in a traffic signal display position.

16. A portable traffic signal as defined in claim 13 including another traffic signalling means secured to said mast means to be moved in unison with the movements thereof.

17. A method of providing a temporary traffic signal including the steps of providing a movable traffic signal supporting structure, mounting a telescoping mast to said signal supporting structure, arranging the telescoping mast in a telescopically collapsed position, pivotally securing a telescoping boom adjacent the free end of said mast, the boom being adapted to mount a traffic signal thereon when in a telescopically extended position, arranging the telescoping boom in a telescopically collapsed position adjacent the collapsed mast with the free end of the boom secured to the supporting structure, transporting the movable supporting structure to a traffic area requiring traffic control after the mast and boom have been arranged as defined hereinabove, telescopically extending the mast and boom in unison while the boom has its free end secured to the supporting structure, releasing the secured boom after the mast and boom have been telescopically extended, mounting traffic signalling means on the released boom to be carried thereby, and positioning the boom in an extended position relative to the mast for displaying the traffic signalling means.

18. A method of providing a temporary traffic signal as defined in claim 17 including the step of mounting a second traffic signalling means on the telescoping mast so as to be displayed in a traffic signalling mode when the mast has been telescopically extended.

19. A method of providing a temporary traffic signal as defined in claim 17 including the step of stabilizing the supporting structure.

20. A method of providing a temporary traffic signal as defined in claim 19 wherein the stabilizing of the supporting structure includes stabilizing the entire extended boom and supporting structure against a skidding effect due to high winds.

21. A method of providing a temporary traffic signal as defined in claim 17 wherein the step of transporting the movable supporting structure to a traffic area is further characterized as arranging the supporting structure alongside the traffic area so that the extended boom is alongside the traffic area and including the step of rotating the extended mast to position the extended boom over the traffic area.

22. A method of providing a temporary traffic signal as defined in claim 21 including releasably securing the rotated mast and boom to the supporting structure.

* * * * *

UNITED STATES PATENT AND TRADEMARK OFFICE

CERTIFICATE OF CORRECTION

PATENT NO. : 4,543,905

DATED : October 1, 1985

INVENTOR(S) : John D. McKenney

It is certified that error appears in the above-identified patent and that said Letters Patent is hereby corrected as shown below:

Column 2, line 24, after "traffic" insert -- signal --.

Column 3, line 29, change "trailerd" to -- trailer --.

Column 4, line 66, change "structure" to -- structural --.

Column 5, line 1, after "and" insert -- a --;
line 9, change "assembles" to -- assemblies --.

Column 8, line 7, change "about" to -- abut --.

Column 11, line 36, change "elevation" to -- elevating --.

Column 14, line 6, change "which" to -- winch --;
line 32, change "unbalasted" to -- unballasted --.

Signed and Sealed this

*Fourth* Day of *February 1986*

[SEAL]

*Attest:*

DONALD J. QUIGG

*Attesting Officer*

*Commissioner of Patents and Trademarks*